US006530182B2

(12) United States Patent
Fanucci et al.

(10) Patent No.: US 6,530,182 B2
(45) Date of Patent: Mar. 11, 2003

(54) LOW COST, LIGHT WEIGHT, ENERGY-ABSORBING EARTHQUAKE BRACE

(75) Inventors: Jerome P. Fanucci, Lexington, MA (US); James J. Gorman, Boxborough, MA (US)

(73) Assignee: Kazak Composites, Incorporated, Woburn, MA (US)

( * ) Notice: Subject to any disclaimer, the term of this patent is extended or adjusted under 35 U.S.C. 154(b) by 0 days.

(21) Appl. No.: 10/039,904

(22) Filed: Oct. 23, 2001

(65) Prior Publication Data

US 2002/0095879 A1 Jul. 25, 2002

Related U.S. Application Data

(60) Provisional application No. 60/242,797, filed on Oct. 23, 2000.

(51) Int. Cl.[7] ..... E04B 1/98

(52) U.S. Cl. ..... 52/167.3; 52/739.1; 52/167.1; 52/167.8; 52/738.1; 52/737.4; 52/167.2; 52/167.4; 52/1; 174/42; 188/378; 267/134

(58) Field of Search ..... 52/167.3, 739.1, 52/167.1, 167.8, 167.7, 738.1, 737.4, 167.2, 167.4, 1; 174/42; 188/378; 267/134, 140.13; 428/495

(56) References Cited

U.S. PATENT DOCUMENTS 901,453 A * 10/1908 Lally ..... 52/283
5,339,580 A * 8/1994 Koshika et al. ..... 52/167 E
5,487,534 A * 1/1996 Sakamoto et al. ..... 52/167.7
5,819,484 A * 10/1998 Kar ..... 52/167.1

* cited by examiner

*Primary Examiner*—Carl D. Friedman
*Assistant Examiner*—Nahid Amiri
(74) *Attorney, Agent, or Firm*—Weingarten, Schurgin, Gagnebin & Lebovici LLP

(57) ABSTRACT

An energy absorbing seismic brace for both retrofit and new construction. The brace comprises a central strut of either multi-legged or homogeneous section fabricated from low strength aluminum, whose characteristics maximize the seismic energy absorption for a building installation. This central strut absorbs energy at high weight-specific levels by virtue of the hysteresis in its load-deflection relationship. In order to eliminate the possibility of buckling of the energy absorbing strut when it passes through the compression portion of a load cycle, it is surrounded by a system of spacers and an external sleeve providing very high bending rigidity at low weight. The spacers may be fabricated from low-density foams, pseudo-concrete, fibrous composites, or metals, depending upon the application. The outer sleeve may also be fabricated from a variety of materials, depending upon whether the embodiment calls for the principal bending rigidity to be provided by the spacers or sleeve.

16 Claims, 6 Drawing Sheets

LOW COST, LIGHT WEIGHT, ENERGY-ABSORBING EARTHQUAKE BRACE

CROSS REFERENCE TO RELATED APPLICATIONS

This application claims priority under 35 U.S.C. §119(e) to Provisional Patent Application Serial No. 60/242,797 filed Oct. 23, 2000; the disclosure of which is incorporated by reference herein.

STATEMENT REGARDING FEDERALLY SPONSORED RESEARCH OR DEVELOPMENT

This invention was made in part with United States Government Support under Contract Number #DACA88-99-C-0006, SBIR Topic #A98-087 awarded by the Department of the Army. Therefore, the U.S. Government has certain rights in the invention.

BACKGROUND OF THE INVENTION

Seismic events often cause dynamic responses in structures sufficient to permanently damage or destroy the primary load-bearing members. Extensive research into the dynamic response of building structures has revealed that modest applications of ancillary damping can dramatically reduce deflections and stresses due to seismic excitation. This ancillary damping may be provided by either yielding and hysteretic energy dissipation in primary structural elements or the inclusion of devices specifically designed to absorb energy while remaining within the elastic range of the primary structure. These latter devices offer the great advantage of minimizing damage to curtain walls, interior structures, and other building systems. In some cases these auxiliary dampers are sacrificial and need replacement after extreme events, while in other cases they may sustain many extreme load cycles without significant maintenance. If effective ancillary damping mechanisms can be developed, in retrofit applications, for multi-storied steel frame buildings, then seismic upgrades of numerous buildings can be significantly expedited.

A wide variety of passive damping schemes have been marketed and implemented with varying degrees of success. These damping devices assume many forms characterized by a wide range of complexity and cost as outlined below; friction dampers, hysteretic (yielding) dampers, lead extrusion dampers, shape memory alloy devices, viscoelastic (rubber or rubber/metal hybrid) isolators, magnetostrictive or magnetorheological devices, tuned mass dampers, and tuned liquid/liquid column dampers. Aside from the tuned mass and/or liquid dampers, the basic damper configuration typically spans a building frame bay, either via a diagonal strut or a chevron brace arrangement. The key design parameters for any of the damper types include maximum force capacity and damper stroke (peak-to-peak in a load cycle). The different damper technologies exhibit hysteresis curves, bounded by these load and stroke parameters, whose shape depends upon the physical characteristics of the damper, and, in the case of viscous dampers, the velocity of the building motion. The required damper stroke is determined by the building displacement limits set either by the appropriate building code or by the builder's assessment of the acceptable damage threshold. In the US, building shear displacement angles (measured as the horizontal displacement of an upper story: the height between the upper story and the story beneath it) of 1:200 are generally considered to be limiting cases, while in Japan, shear displacement angles of 1:100 are tolerated.

One successful example of the damping devices outlined above has been the line of fluid viscous dampers by Taylor Devices, Inc. of North Tonawanda, N.Y. These fluid viscous dampers are essentially superscale versions of automotive shock absorbers, with load capacities ranging from 10 kips to 2000 kips, and strokes of up to 120 inches. While providing effective damping forces out of phase with the excitation, the fluid viscous dampers are relatively complex and costly and may not provide the desired design flexibility and longevity.

A recent development in hysteretic dampers fabricated from low strength steel and concrete by Nippon Steel has shown good performance with a minimum of complexity and cost. This damper mechanism has been used in several new-build projects in Japan. One implementation of this damper brace is a welded steel box of approximately 55 cm by 65 cm filled with concrete enclosing a low strength steel brace having a cruciform shape. Braces have been fabricated having a free length of just over 20 meters and weighing approximately 34 tons. The weight of the concrete-filled steel sleeve is very high and renders retrofit application of the damping brace difficult, if not impossible. The cost of this damping method is driven upward by the proprietary nature of the very low yield strength steel (100 Mpa/14.5 ksi) used in the strut.

The technology options for seismic energy absorbers currently available include: the Nippon Steel hysteretic strut brace and sleeve combination, yielding plate dampers, and viscous dampers such as the Taylor Devices line. While there are several other technologies that have some promise (lead extrusion, shape memory alloy, magnetorestrictive), these are not currently available on a commodity basis.

BRIEF SUMMARY OF THE INVENTION

A lightweight hysteretic damper is useful for framed buildings to reduce seismic response levels. A seismic brace incorporates a low-strength aluminum multi-armed strut that plastically deforms during a seismic event, damping a building's response because of the hysteresis in the strut material stress-strain curve. This strut is surrounded by a collar providing high bending stiffness, but no extensional stiffness, to prevent a low energy buckling failure of the brace in compression. The collar is composed of an outer sleeve of composite materials or metal construction, and spacers to provide the requisite load transfer from the strut which is free floating within the collar. Substantial improvements in weight-specific energy absorption and cost as compared to extant damper concepts are possible.

The hysteretic seismic damper employing a yielding central strut surrounded by a buckling suppression collar is utilized mounted along one or more diagonals of a building frame, and reduces structure seismic response by absorbing strain energy (providing extra damping). In order to maximize this damping energy absorption, the brace remains stable in both tension and compression load cycles to a significant level of plastic strain. When under significant compressive strain, the tangent modulus of the structural material is much lower than its initial modulus, introducing the requirement for a very rigid collar to prevent strut/brace buckling. Composite materials provide an opportunity to create such a collar at minimum weight and cost while metals employ known manufacturing methods.

In one embodiment utilizing a cruciform strut, the aluminum strut is surrounded by four hollow quarter-rounds of metal or composite construction, each of which contains both longitudinal and shear stiffness that in the aggregate is sufficient to prevent strut buckling up to its compressive yield strength. The quarter rounds are attached to one an r and contained about the aluminum strut by a sleeve providing reinforcement mostly in the hoop/bias direction. For field assembly, the collar is assembled around the strut with the sleeve bonded to the spacers in the field using a room-temperature-curing adhesive. Factory assembly is an alternative although this field assembly embodiment is particularly well suited to retrofit applications.

In another embodiment, the aluminum strut is surrounded by four lightweight quarter-rounds, each of which is sufficient to transfer radial stresses to an outer sleeve. The four quarter-rounds may be attached to one another and are contained about the aluminum strut by a reinforced sleeve that contains both longitudinal and shear stiffness sufficient to prevent strut buckling up to its compressive yield strength. The sleeve is bonded to the spacers with an adhesive. This concept is optimized for initial installation applications since it can be constructed at greater lengths than the previous embodiment. Other aspects, features, and advantages of the present invention are disclosed in the detailed description that follows.

BRIEF DESCRIPTION OF THE SEVERAL VIEWS OF THE DRAWING

The invention will be understood from the following detailed description in conjunction with the drawings, of which.

DETAILED DESCRIPTION OF THE INVENTION

Figure 1:
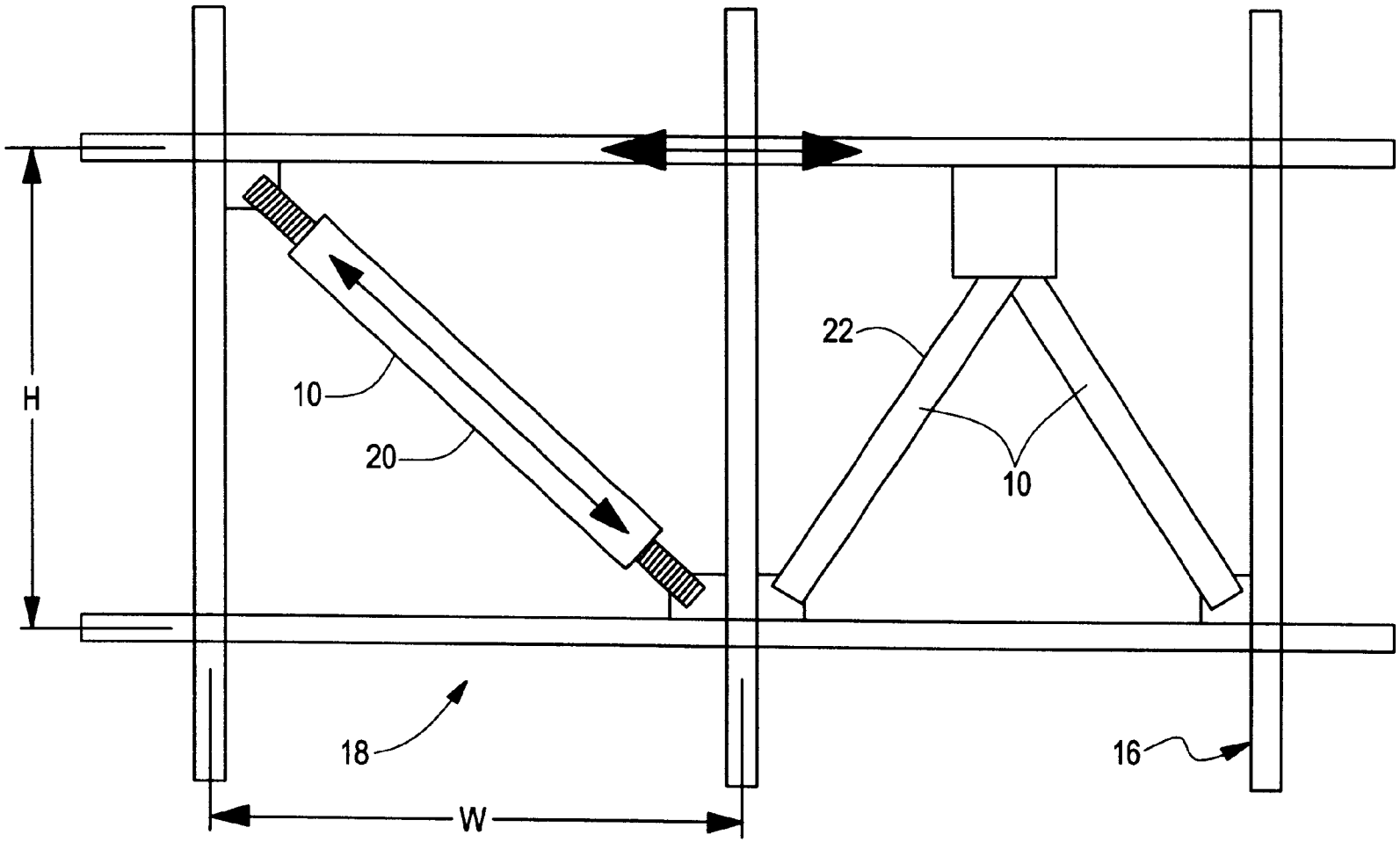
FIG. 1 is a diagram illustrating placement of braces according to the invention.
Figure 2:
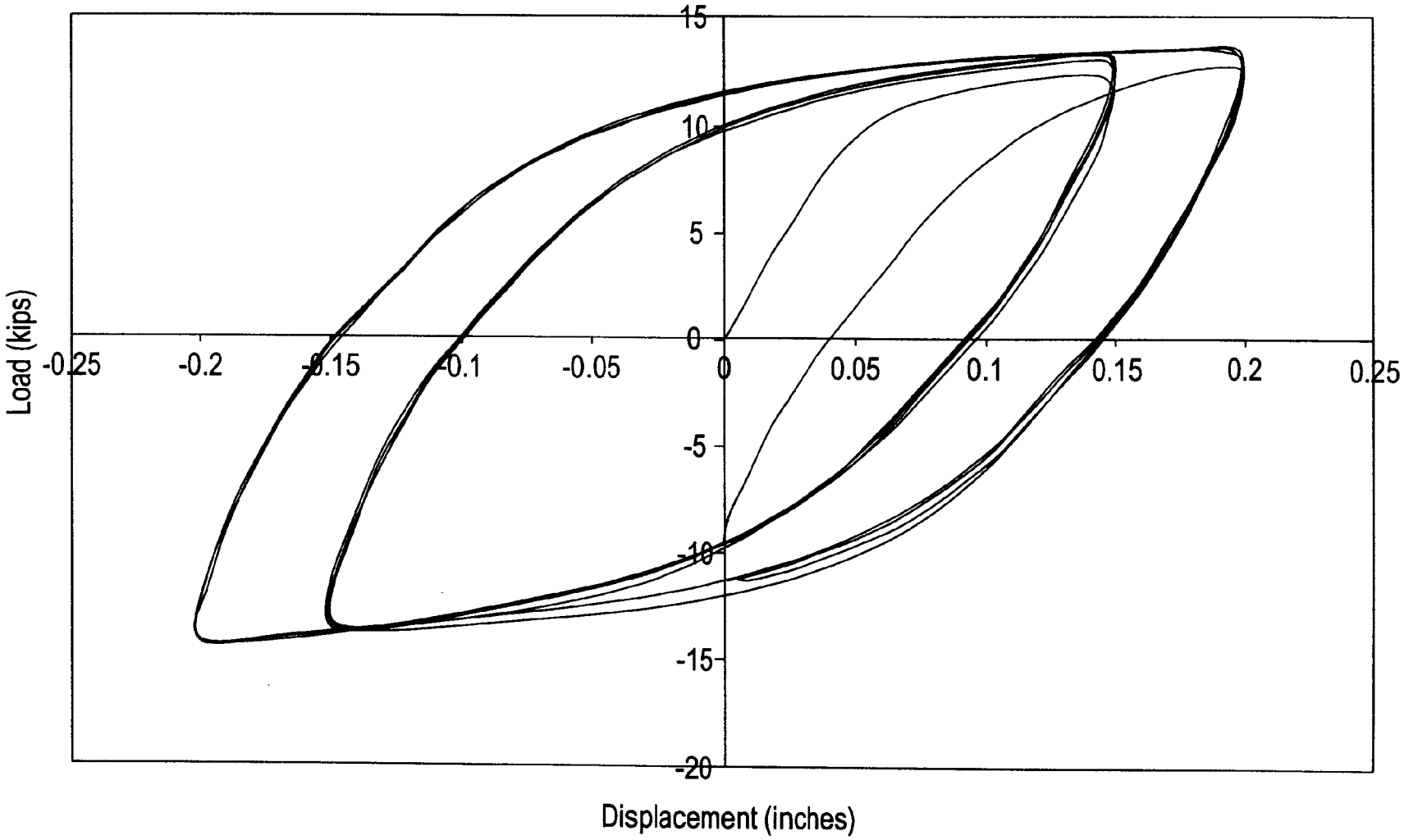
FIG. 2 is a desirable load deflection curve.

FIG. 1 illustrates a structure 16 incorporating a seismic brace 10 according to the present invention. The brace spans a building frame bay 18, via either a diagonal strut 20 or a chevron brace 22 arrangement. The key design parameters for the braces include maximum force capacity and damper stroke (peak-to-peak in a load cycle). The braces return hysteresis curves bounded by these load and stroke parameters, such as shown in FIG. 2. Forces of 10,000 pounds or more move the brace up to 0.2 inches in this particular example. The shape of the hysteresis curves depends upon the physical characteristics of the brace. The goal of the brace is to absorb building response energy associated with a seismic event. The strut material is required to be driven substantially into the yield regime without failure at a yield stress that allows significant energy absorption in a package of tractable size. The brace material must further accommodate the expected number of load cycles without significant fatigue damage.

The specific loading and weight requirements for any particular application depend upon the frame bay proportions (H, W), the maximum allowed angle limit (typically 1:200) and the specific seismic event. The disclosed seismic brace withstands a yield load from 12–48 kips in one prototype implementation, but may easily be designed to achieve much larger load capacity.

A feasible and cost-effective hysteretic seismic brace meets these requirements by exercising in cyclic fashion a low strength aluminum strut surrounded by a buckling suppression collar. The collar is implementable utilizing combinations of metal, composite and lightweight materials. The seismic brace is composed of a central yielding strut that can be manufactured in a variety of multi-armed shapes. The central strut is surrounded by filler or spacer material contained by an outer sleeve. The filler and sleeve suppress buckling of the brace when the strut is stressed in compression. In many implementations, the central strut is made of annealed low-strength aluminum.

Figure 3A:
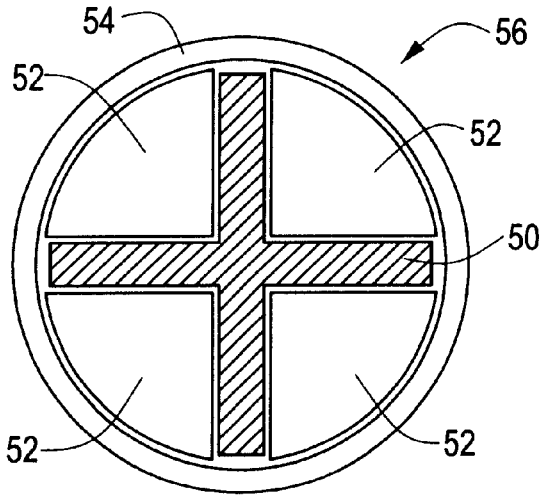
FIG. 3A is an illustration of a brace cross section with a multi-arm strut according to the invention.
Figure 3B:
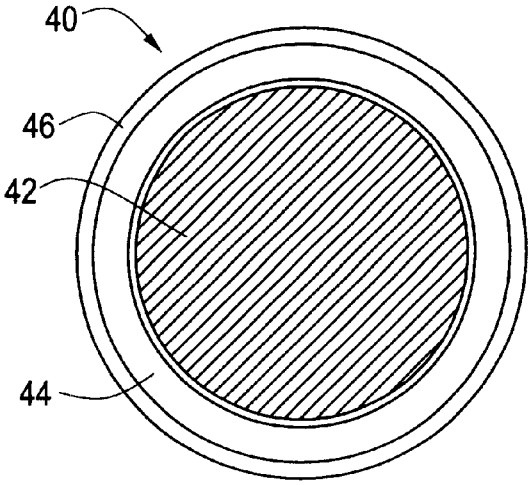
FIG. 3B is an illustration of a brace cross section with a solid strut.

The basic configurations of the seismic braces according to the invention are shown in FIGS. 3A and 3B. Brace implementations using a cruciform or other multi-armed strut and a solid strut configuration are illustrated. All of the struts, whether of cruciform or cylindrical configuration, are fabricated from annealed aluminum with a yield strength between 7 to 15 ksi. Several nearly pure aluminums, 1100 and 1060 series, show yield strengths in this range. In addition, several of the 2000, 3000, 5000, and 6000 series aluminum alloys have sufficiently low yield strengths but exhibit too much age-hardening to be considered. For many implementations, 1100-O annealed aluminum is preferable.

FIG. 3A illustrates a circularly symmetric multi-armed strut 50 with a lightweight spacer 52 filling the space between the legs of the strut 50. The strut 50 and spacer 52 are circumscribed by an outer sleeve 54. An optional slip agent (not shown), such as a mold release agent, silicone or Teflon™ film is employed between strut 50 and spacer 52 to permit the hysteretic action of the strut to be unencumbered by the longitudinal stiffness of the spacer 52 and sleeve 54. The desirability of such slip or release agents will be determined in each particular application case. For some applications, the natural lubricity of the constituent members may be sufficient to fulfill the stiffness-isolation function. For illustration purposes the multi-armed strut is shown as a cruciform shape, although shapes such as a tribach, star and I-section can be used. These shapes provide an axisymmetric (about the longitudinal axis) stiffness, with the tribach (three-armed) cross-section providing significant advantages in assembling end fittings.

For the multi-armed strut 50, the basic alloy and temper may be varied to "tune" the load capacity. Annealed aluminum alloys serve as the central yielding strut 50 in this brace assembly 56, Non-aging alloy compositions are necessary, since the service life of the seismic brace is expected to be very long (e.g. 20–50 years). In particular, 1100-O annealed aluminum is well adapted to serve as the brace strut 50. For the multi-armed strut 50 1100-O annealed aluminum shows a material yield strength of approximately 10 ksi, and strain to failure well beyond 1%. The multi-armed strut 50 may be manufactured using extrusion or be welded from strip material.

While the 1100-O annealed aluminum exhibits the hysteretic properties needed, the resultant strut 50 must be reinforced to provide sufficient stiffening to suppress brace buckling at a reasonable weight and cost. A reinforcing outer collar (described below) is well suited to provide the stiffening. A sleeve 54 and spacer 52 together form the collar accomplishing the suppression of brace buckling.

The spacers 52 and sleeve 54 accomplish the buckling resistance as a system. When the spacer 52 serves primarily a stress transfer function, the sleeve 54 supplies the buckling suppression rigidity. When the spacer 52 performs more of the buckling suppression, the sleeve 54 may provide less of the buckling suppression rigidity, although the full function sleeves may still be used.

Figure 4A:
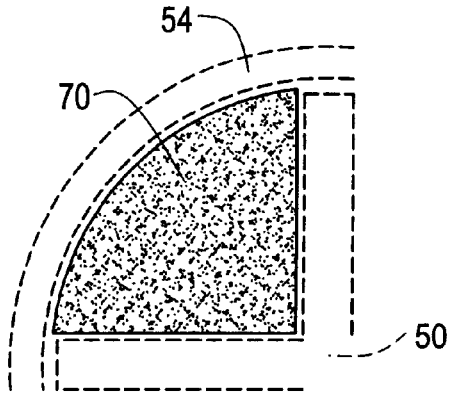
FIG. 4A is an illustration of a foam spacer according to the invention.

In a first implementation, shown in FIG. 4A, structural foam of approximately 20 lb/ft$^3$ density (or less) is used as the spacer 70 between the arms of the multi-armed strut 50. The spacer 70 requires that all of the anti-buckling rigidity be supplied by the outermost sleeve 54. An adhesive bonds the spacers 70 to the outer sleeve 54 and an optional slip agent may buffer the strut 50 and the spacer 70 preventing the application of any longitudinal restraint by the collar. The function of the foam spacers 70 is to provide a normal force restraint, effectively centering the aluminum multi-armed strut 50 within the outer sleeve 54, and preventing any high frequency flange buckling which might be possible without deforming the sleeve 54. This implementation is an economical configuration most amenable to factory assembly. The fully-assembled brace 56 using the foam spacer 70 is best suited to new-build applications.

A range of structural foams and pseudo concrete materials can be used in spacer 70 to provide relatively low weight at an attractive cost. The tradeoffs among these materials are related to cost, density, and performance. Compression strengths of the order a few hundred psi are sufficient for the spacer 70, so that polymer foams of greater than 10–15 pounds per cubic foot (pcf) provide good service. In this range, there are many possible choices, ranging from homogeneous foams to syntactics. Phenolic resins and foams have the desirable characteristic of being essentially fireproof, emitting no toxins when subjected to flame.

Other choices for structural foams include polyurethane or PVC foams, epoxy based syntactic foams, or pseudo-concrete materials incorporating polymer matrices filled with inexpensive components such as fly ash, vermiculite, and pearlite. These materials are suitable for applications in which cost is a more important consideration than weight. The polymer foams are all quite expensive in the densities contemplated, but provide a 2×–3× weight advantage over the pseudo concretes (and 6×–10× as compared to regular concrete). A low initial cost fabrication method for spacer 70 is to cut the foam shapes on a shaper table, at the cost of some wasted foam. Large-scale production of the foam spacers 70 uses net-shape casting, with relatively high initial tooling cost but lower recurring cost.

The foam spacers 70 require a sleeve 54 that provides the anti-buckling function. The reinforcing sleeve 54 for the foam spacers 70 is a continuous cylinder with a suitable combination of longitudinal and off axis reinforcement. This sleeve can be fabricated from metal or composite material. Since the outer sleeve 54 is a continuous cylinder running approximately the entire length of the brace (in many cases approximately nine meters—30 ft.—or greater) that must be intimately bonded to the spacers 70 and not bonded to the multi-armed strut 50, assembly is done in a factory-bonding fixture.

A metallic outer sleeve may be fabricated from rolled steel or aluminum sheet material of suitable alloys and provided with a fastening of the longitudinal edges of said sleeve via welding or other mechanical fastening means.

Figure 5:
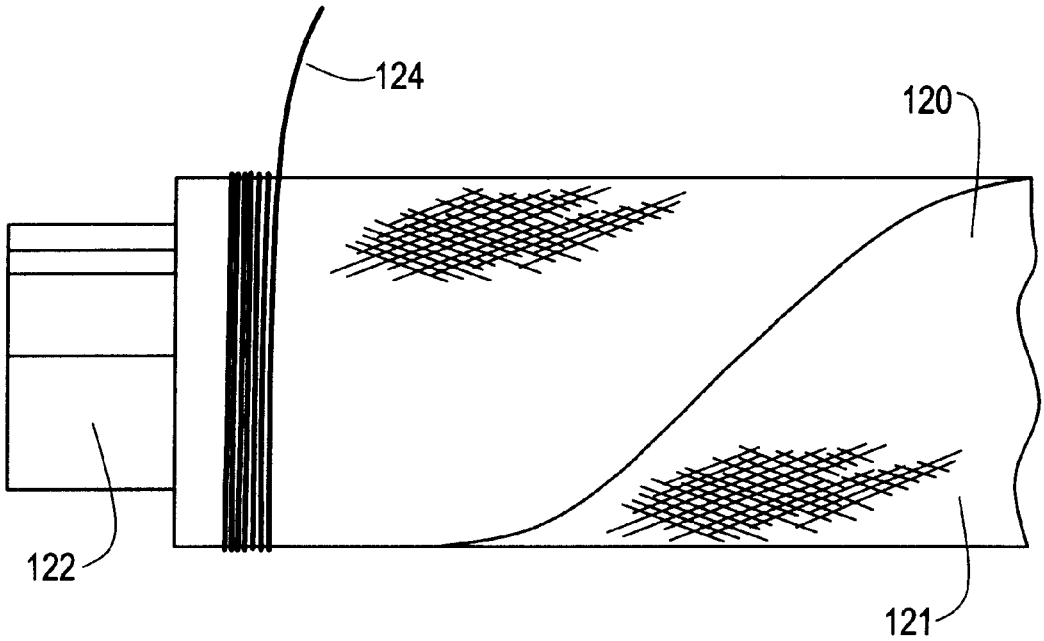
FIG. 5 is a detail of construction of an implementation of a brace according to the invention.
Figure 6:
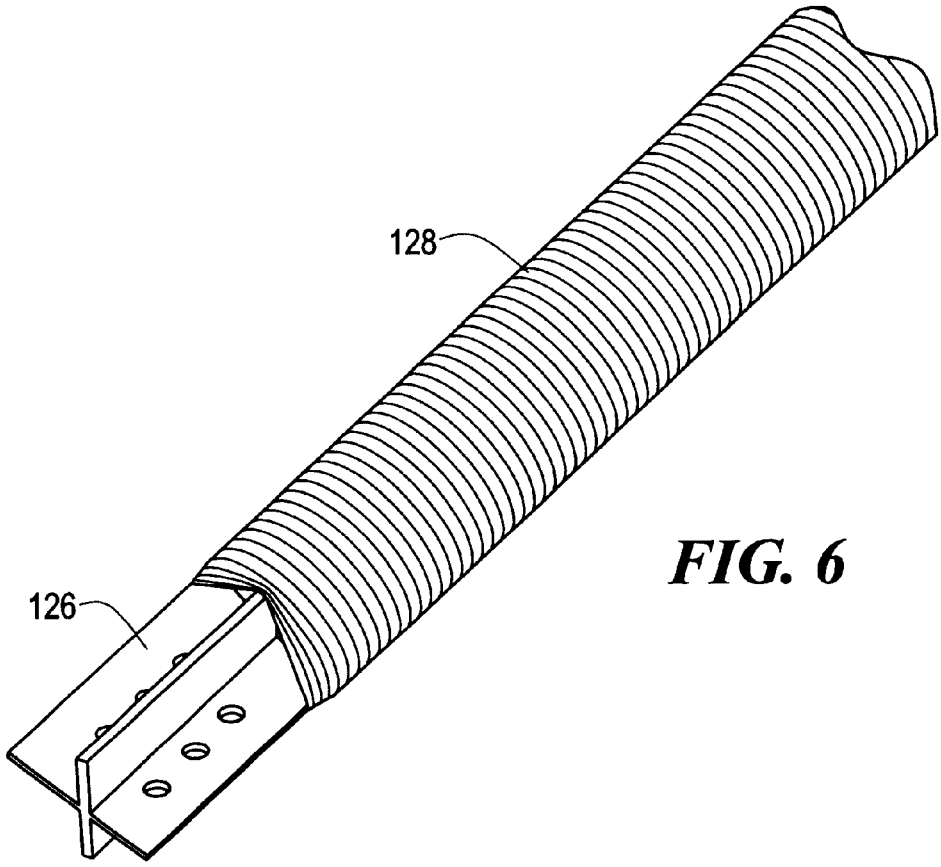
FIG. 6 is a view of a completed brace according to the invention.

A composite outer sleeve 54 may be fabricated using a variety of methods including filament winding, roll wrapping and pultrusion. One manufacturing method for a brace using the foam spacers 70 is illustrated in FIG. 5. The spaces in the angles of the multi-armed strut 122 are filled with the stiff polymer foam (not shown) which is bonded to an outer sleeve 120 and not the strut 122. The sleeve 120 is most conveniently constructed of fabric 121 such as graphite fabric, filament wound or roll-wrapped using the aluminum strut 122 and foam spacers as a mandrel. After wrapping, glass fiber 124 is over wrapped around the sleeve 120 and the wrapped sleeve is impregnated with resin (the resin bonds the sleeve to the foam spacer, but not to the strut, in the process). The finished assembly is then oven-cured. The completed brace is illustrated in FIG. 6 where the strut 126 is shown prepared for mounting to structural joint adapters, and the cured sleeve 128 extends to nearly the entire length of the brace. This implementation has a cost advantage because the structural parts are simple to fabricate. This implementation is adapted to factory assembly especially in larger sizes and does not readily allow assembly at the construction site. The cost/performance tradeoffs of selecting materials and manufacturing methods for a composite sleeve are the classic ones common to most fiber-reinforced composite applications as are known in the art.

Figure 4B:
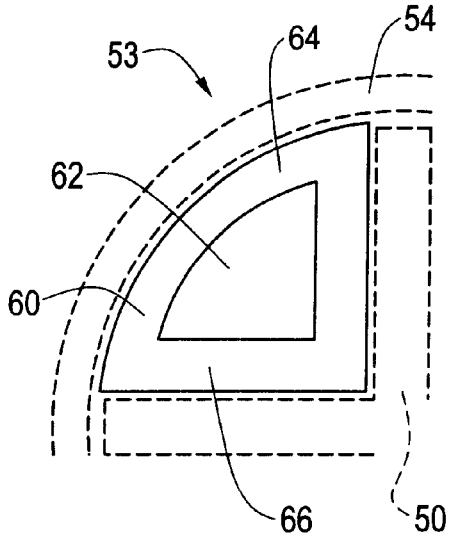
FIG. 4B is an illustration of a hollow rigid spacer according to the invention.

In another spacer implementation illustrated in FIG. 4B, the spacers 53 are hollow structures having sufficient bending and shear rigidity to suppress buckling of the strut 50 under the intended yielding load. The outermost sleeve 54 for the hollow spacer is only required to hold the entire assembly together, providing shear and hoop rigidity from one to the other of the hollow spacers 53. However, the high rigidity buckling suppression sleeve described above can also be used with spacer 53.

The hollow spacer 53 consists of walls 60 and an enclosed space 62. The walls 60 of the spacer 53 can be made of a fiber-reinforced composite material or a metal such as steel or aluminum alloys, or a hybrid construction comprising both metallic and composite elements. The composite hollow spacers 53 are easily fabricated via pultrusion or any variety of winding process. The winding approaches are applicable especially for initial production, having relatively low non-recurring tooling cost but moderate recurring cost. Pultrusion is more applicable to large-scale production, due to its extremely low recurring cost, married to relatively high initial tooling cost. Pultruded composite spacers 53 contain a reinforcement that provides a large measure of bending rigidity to stiffen the aluminum strut 50 during the compression portion of a load cycle. Because of the reinforcement requirement, the circular arc portion 64 of the cross section is composed largely of longitudinal fibers. The right-angle portion 66 of the cross section contains a balanced fabric reinforcement to provide a combination of longitudinal, transverse, and shear stiffness.

The material and fabrication tradeoffs for the hollow reinforced composite spacers 53 are quite similar to those for the outer sleeve used with the foam spacer 70 discussed above. In one embodiment, spacer mandrels are used as the foundation for fabricating the hollow composite spacers 53. Care must be taken to assure the mandrels will release the spacers 53. In this fabrication process, glass fabric was first wrapped around the released mandrels and longitudinal graphite fibers were added on the outermost curved surface 64. These graphite fibers were in turn sandwiched by another layer of glass cloth, effectively capturing the graphite reinforcement. Vinyl Ester resin was then impregnated into the dry hybrid composite wrapped around the aluminum mandrel. Once the reinforcement was completely wetted, the whole assembly was wrapped in shrink tape and cured in the oven at 250 F. for 3 hours.

An advantage to the use of hollow spacers 53 is that for some sleeve implementations, the individual parts of the brace 56 can be carried to an installation site separately and assembled at the installation site using, for instance, a room-temperature-curing construction grade adhesive between spacer 53 and sleeve 54. Field assembly renders brace 56 especially amenable to retrofit installations, where the size and weight of components represent a significant barrier to installation. While the sleeves described above in conjunction with foam spacer 70 may be used in conjunction with spacer 60, these are not as readily amenable to on-site assembly.

Figure 7:
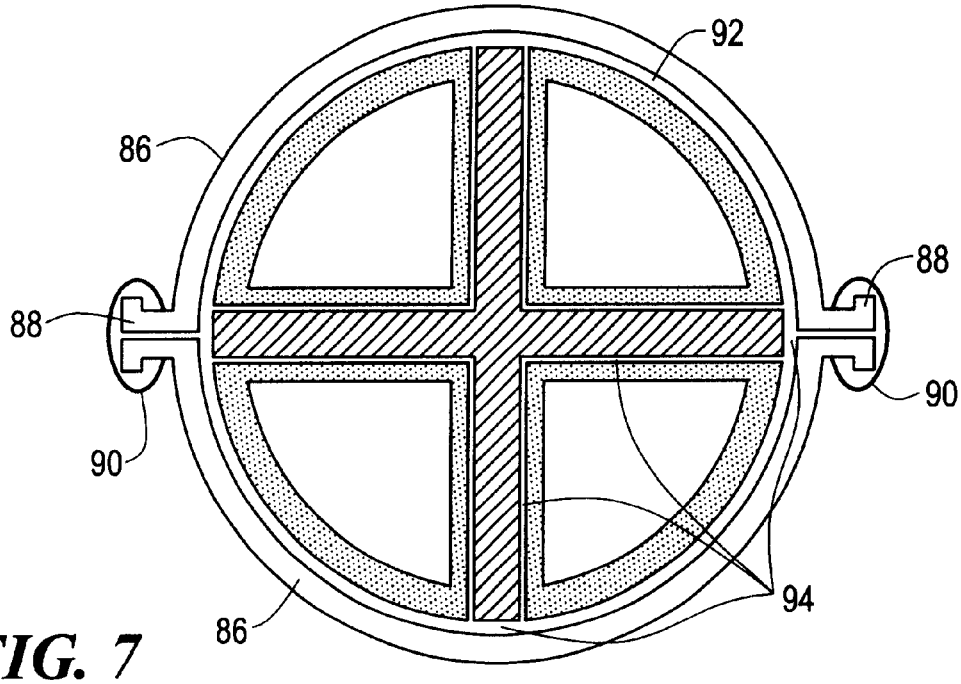
FIG. 7 is an illustration of a cross section of a brace with a clamshell outer sleeve according to the invention.
Figure 8:
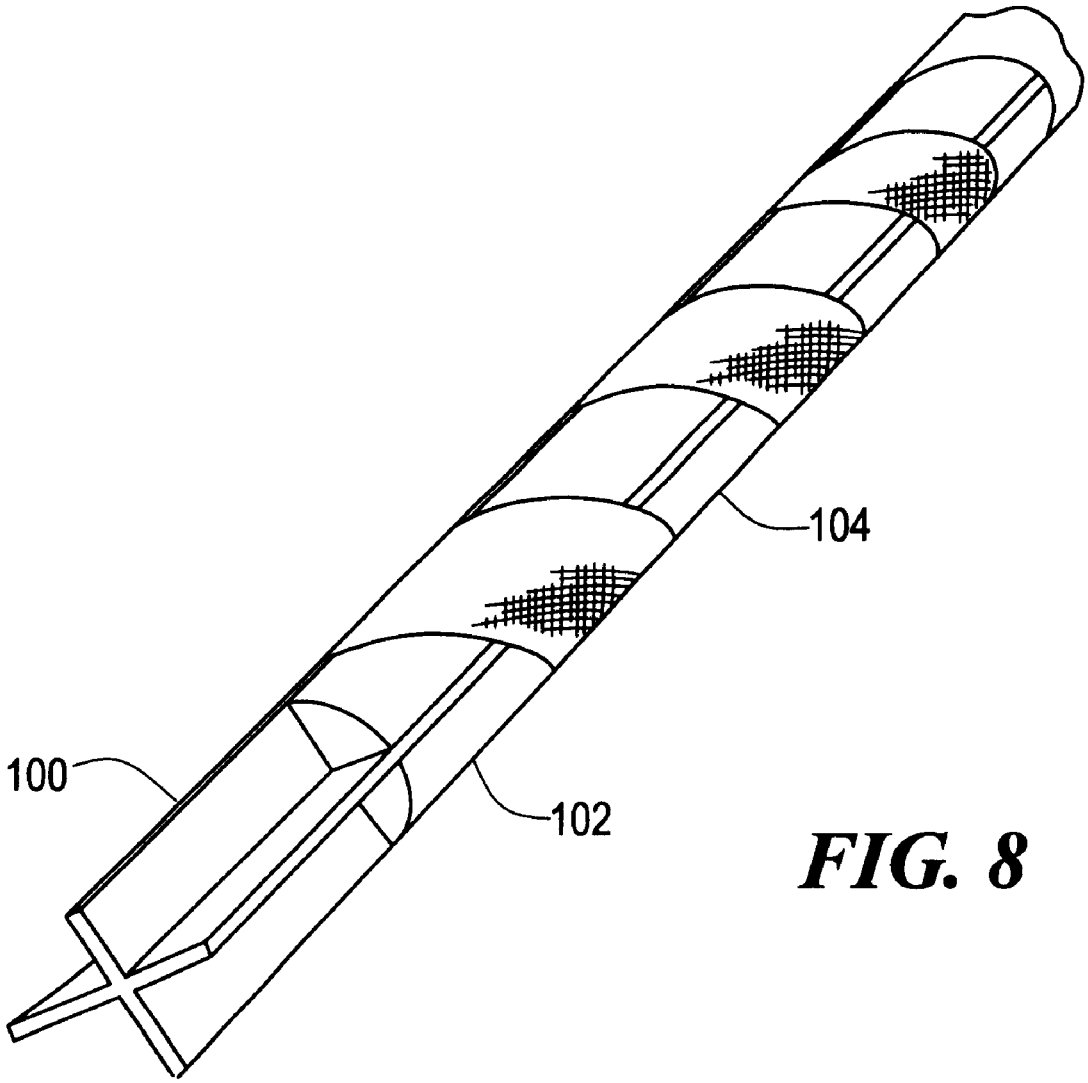
FIG. 8 is a detail of construction of a brace with a helical split sleeve according to the invention.

FIGS. 7 and 8 illustrate two embodiments for an outer sleeve 54 that is amenable to on-site assembly. The first embodiment, a split clamshell, is shown in FIG. 7. The individual clamshell halves 86 are extruded or pultruded with lugs 88 on the long edges. These lugs 88 are secured by a fastening mechanism such as a formed sheet metal clamp 90 that is hammered over the pair of lugs 88 from the two halves of the clamshell, a bolt pattern disposed along the clamshell flanges, or other fastening mechanism. FIG. 7 also illustrates the bonded region 92 and the unbonded regions 94 of the brace.

A second embodiment shown in FIG. 8 utilizes hollow spacers 102 that are placed within the angles of the multi-armed strut 100 coated with a suitable release agent so as to slide with respect to the strut 100. A spirally split "barber pole"—type sleeve 104 is snapped over the strut/quadrant spacer assembly 100/102. After the spiral sleeve 104 shown is installed, a second spiral sleeve piece (not shown) is installed in the interstitial areas to provide complete coverage to the brace assembly 100/102. The sleeves 104 are bonded to the outer circumference of the hollow spacer assemblies 102 with a construction-grade adhesive.

The outer sleeve of the clamshell 86 or split spiral 104 type can be economically fabricated using simple tooling. These sleeves hold the quadrant pieces 102 tight against the aluminum strut 100, and provide a stiff shear interface and hoop rigidity between these pieces across the outstanding radial edges of the aluminum strut 100. The sleeves need not provide significant added bending rigidity. The individual piece parts comprising the brace can be carried to the installation site separately and assembled on-site with room-temperature-curing construction grade adhesive (between spacer and sleeve).

The alternate configuration of the brace shown in FIG. 3B illustrates a brace 40 with a solid center hysteretic bar strut 42 surrounded by an optional relatively uniform lightweight spacer 44 fabricated of material such as may be used in spacer 70. The outer surface of the spacer 44 is sheathed by an outer sleeve 46. The sleeve 46 for this brace 40 may be any sleeve applicable to spacer 70 described above. The shape of this brace and strut configuration may be varied as the building requirements dictate. An optional slip agent (not shown) may be employed between strut 42 and spacer 44 to permit the hysteretic action of the strut to be unencumbered by the stiffness of the sleeve 46.

A strut 42 having a circular cross section is desirable from the point of view of symmetry and ease of fabrication, but it is limited in its effective energy absorption capacity. When either filled or surrounded by a sheathing material of considerable hoop/radial integrity, a transverse stress is developed by Poisson effects that increases the yield stress/load by perhaps 15% as compared to the unconstrained value. This behavior may reduce the effectiveness of the solid core strut 42. The brace of FIG. 3B can, however, have significant value as a seismic brace for light construction, or locations where space in the curtain wall is at a severe premium. This is the simplest configuration to fabricate, and will be less expensive to build and install than any of the multi-armed embodiments described above.

For composite sleeves used with the solid strut 42, a greater thickness of composite or other high rigidity material is required in the sleeve 46 to stabilize the buckling failure mode with the simple rod brace 40 than will be true for the multi-armed strut configurations above.

The method of attaching the brace to the building structure of interest is critical to the effectiveness of the seismic brace. When the central strut is working properly, it is by definition yielding, and the secondary modulus for most structural metals suitable for yielding struts will be quite low. This situation demands that measures be taken which prevent local buckling of the strut, especially any flanges near the end of the strut. Any end fitting must satisfy the strength and grip interface requirements and allow the sleeve to be installed or manufactured easily onto the brace without interference from plates or other fitting details. Extremely stiff support for the aluminum strut is required to within a very small distance of the outer sleeve 54 surrounding the multi-armed strut.

Finite element analysis showed that the seismic brace can provide good and stable energy absorption at relatively light weight. The buckling safety factor for the multi-armed aluminum strut was much higher than that for the solid strut. Additionally, the end fittings used to attach the braces to a structure must be designed to transfer the load into the brace.

Laboratory testing on a specific configuration of prototype braces with foam spacers 70 showed that peak load capacity of the multi-armed strut can exceed +/−12,000 pounds, while the yield load is approximately 8,000–10,000 lb. The test for hollow spacers 53 yielded results similar to that observed for foam spacers 70, indicating that the split sleeve brace configuration is equally able to support the compression portion of the load cycle, as compared to the stiff sleeve/foam spacer embodiment. The tests on round bars, with composite stiffening sleeve showed that this embodiment does not tolerate as much yielding displacement as the multi-armed strut brace. The basic result of this prototype testing is that the seismic brace implementations provide good and stable energy absorption at relatively light weight.

The multi-armed brace with both spacer implementations was shown to possess excellent damping characteristics, and a basic robustness to the required load cycling. The described seismic braces provide good and stable energy absorption at relatively light weight. Refined end fittings to attach the braces to the structures are important to maintain the brace performance.

A stiff sleeve/foam spacer configuration with a composite sleeve showed peak compression load values essentially equaling or exceeding the peak tension values. This result indicates that the composite sleeves at least performed their main requirement of eliminating the very low strength buckling failure mode. Reviewing the load-displacement curves for the tests show further that in all cases good energy absorption was achieved in the cyclic hysteresis curves.

Having described preferred embodiments of the invention it will now become apparent to those of ordinary skill in the art that other embodiments incorporating these concepts may be used. Accordingly, it is submitted that the invention should not be limited by the described embodiments but rather should only be limited by the spirit and scope of the appended claims.

What is claimed is:

1. An apparatus for bracing a structure from seismic shock, said apparatus comprising:

an elongated multi-armed central strut of continuous construction having opposite ends adapted to receive fastening devices, said elongated multi-armed central strut adapted to plastically absorb both tension and compressive forces to maximize an energy absorption capacity of the apparatus;

a plurality of spacer members each adapted to abut a portion of said elongated multi-armed central strut, an outside surface of said plurality of spacer members and at least one radial extremity of said elongated multi-armed central strut forming a cylinder, said cylinder encompassing substantially an entire length of said elongated multi-armed central strut, excepting said opposite ends;

a buckling-restricting sleeve disposed about said cylinder; and an adhesive to adhere said plurality of spacers to said buckling-restricting sleeve.

2. The apparatus of claim 1 further comprising a chemically applied lubricating and release agent disposed on surfaces of said elongated multi-armed central strut.

3. The apparatus of claim 1 further comprising a film-based lubricating and release agent disposed on surfaces of said elongated multi-armed central strut.

4. The apparatus of claim 1 wherein said fastening devices are bolts.

5. The apparatus of claim 1 wherein said plurality of spacer members are constructed of materials chosen from the group of fiber-reinforced composite materials and metallic materials, said spacer members designed to suppress compressive buckling of said elongated multi-armed central strut, and wherein said sleeve is constructed of materials chosen from the group of fiber-reinforced composite materials and metallic materials, said sleeve disposed about said cylinder distributing buckling suppression force among said plurality of spacer members.

6. The apparatus of claim 1 wherein said elongated multi-armed central strut is composed of an annealed aluminum alloy possessing yield strength of less than 20,000 psi.

7. The apparatus of claim 6 wherein said annealed aluminum alloy is a 1100-O annealed aluminum.

8. The apparatus of claim 5 wherein said plurality of multi-armed spacers are composed of reinforced composite built around a mandrel with a hollow central volume.

9. The apparatus of claim 5 wherein said sleeve is formed as a pair of half helices.

10. The apparatus of claim 5 wherein said sleeve is formed as a pair of shells, each shell configured as a trough adapted to enclose part of said cylinder, said shells having flanges on each longitudinal edge, said flanges adapted to be clamped by a device to hold said shells together.

11. The apparatus of claim 1 wherein said sleeve is formed as a pair of shells, each shell configured as a trough adapted to enclose part of said cylinder, said shells having flanges on each longitudinal edge, said flanges being provided with a fastener designed to hold the longitudinal edges of said shells together.

12. The apparatus of claim 1 wherein said fastener is a set of bolts.

13. An apparatus for bracing a structure from seismic shock, said apparatus comprising:

an elongated cylindrical central strut of continuous construction having opposite ends adapted to receive an attachment mechanism, said elongated cylindrical central strut adapted to plastically absorb both tension and compressive forces imparting energy absorption capacity to said apparatus;

a plurality of spacer members adapted to abut a portion of said elongated cylindrical central strut, an outside surface of said plurality of spacer members forming a cylinder encompassing substantially the entire length of said cylindrical central strut, excepting said opposite ends, said plurality of spacer members constructed of a lightweight material and a bonding agent to form said spacer member;

a buckling-restricting sleeve disposed about said spacer members said buckling-restricting sleeve fabricated from materials chosen from the group of fiber-reinforced composite materials and metallic materials; and an adhesive to adhere said plurality of spacers to said sleeve.

14. The apparatus of claim 13 further comprising a chemically applied lubricating and release agent disposed on a circumferential surface of said elongated cylindrical central strut.

15. The apparatus of claim 13 further comprising a film-based lubricating and release agent disposed on a circumferential surface of said elongated cylindrical central strut.

16. The apparatus of claim 1 wherein said plurality of spacer members are constructed of a lightweight material and a bonding agent to form said spacer members.

* * * * *

UNITED STATES PATENT AND TRADEMARK OFFICE

CERTIFICATE OF CORRECTION

PATENT NO. : 6,530,182 B2
DATED : March 11, 2003
INVENTOR(S) : Jerome P. Fanucci et al.

It is certified that error appears in the above-identified patent and that said Letters Patent is hereby corrected as shown below:

Column 3,
Line 2, “an r” should read -- another --.

Signed and Sealed this

Twenty-third Day of September, 2003

JAMES E. ROGAN
*Director of the United States Patent and Trademark Office*